US005373227A

United States Patent [19]

Keeth

[11] Patent Number: 5,373,227

[45] Date of Patent: Dec. 13, 1994

[54] CONTROL CIRCUIT RESPONSIVE TO ITS SUPPLY VOLTAGE LEVEL

[75] Inventor: Brent Keeth, Boise, Id.

[73] Assignee: Micron Semiconductor, Inc., Boise, Id.

[21] Appl. No.: 37,963

[22] Filed: Mar. 26, 1993

[51] Int. Cl.[5] ..... G05F 3/16

[52] U.S. Cl. ..... 323/313; 323/274; 323/299; 327/74; 327/541; 327/72

[58] Field of Search ..... 307/272.3, 296.4, 296.5, 307/350, 358; 323/274, 284, 299, 312, 313, 315

[56] References Cited

U.S. PATENT DOCUMENTS 3,898,486 8/1975 Wessel et al. ..... 307/297
4,481,430 11/1984 Houk et al. ..... 307/296 R
4,965,469 10/1990 Kondoh et al. ..... 323/315 X

*Primary Examiner*—Steven L. Stephan
*Assistant Examiner*—Y. Jessica Han
*Attorney, Agent, or Firm*—Henri J. A. Charmasson; John D. Buchaca

[57] ABSTRACT

In an integrated microcircuit device the supply voltage is monitored by a pair of threshold detector logic circuits configured to generate a first control signal when said supply voltage crosses over a minimum level, and a second control signal when said supply voltage crosses over a maximum level. The control signals are used to configure the device into distinct modes of operation, whereby the functions of the device and the voltage level of the power supply applied to them during testing or operation may be controlled by varying the supply voltage.

13 Claims, 3 Drawing Sheets

FIG. 1
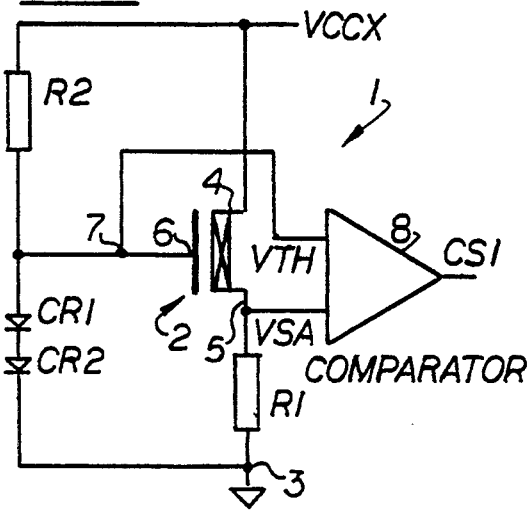
FIG. 2
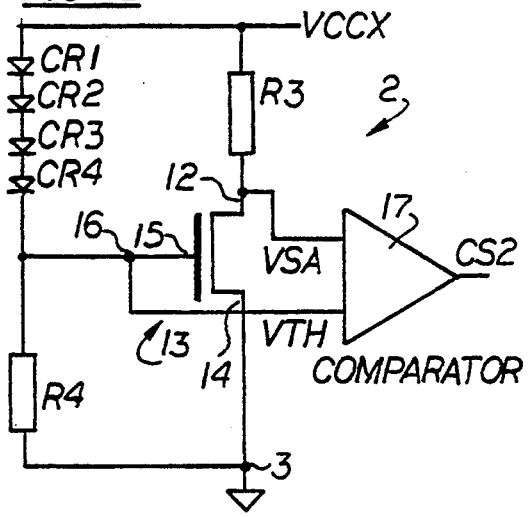
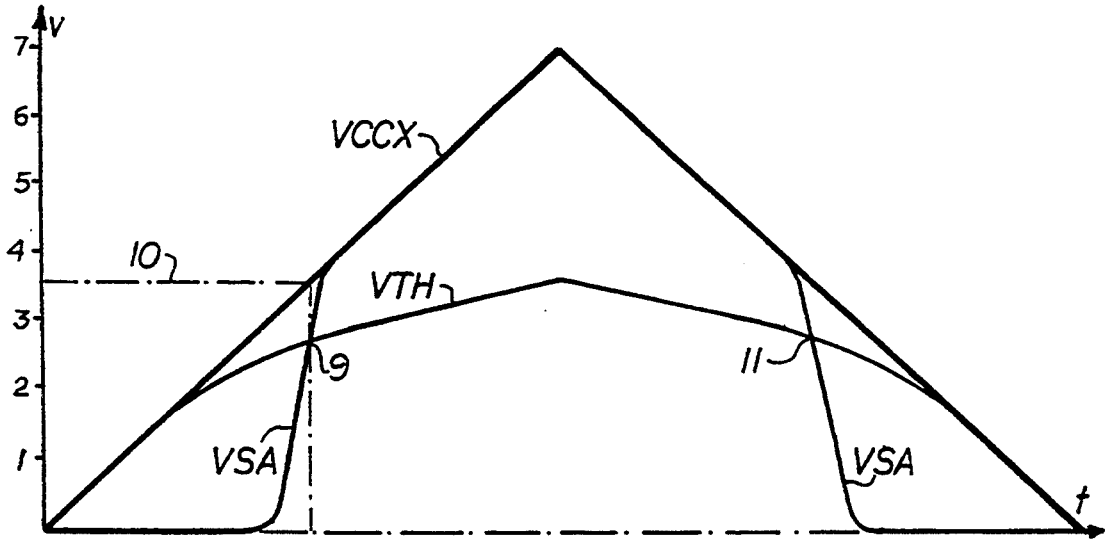
FIG. 3
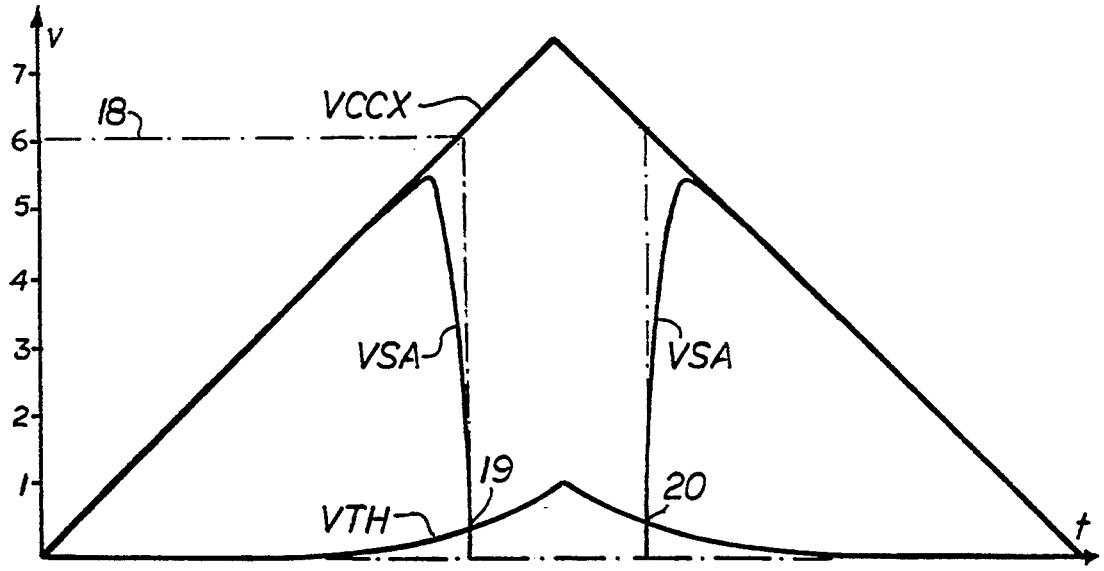
FIG. 4

CONTROL CIRCUIT RESPONSIVE TO ITS SUPPLY VOLTAGE LEVEL

FIELD OF THE INVENTION

This invention relates to the testing of microcircuit chips, and more specifically to test mode detectors used on integrated microelectronic devices for controlling their operations in response to changes in the level of power supply voltages.

BACKGROUND OF THE INVENTION

Integrated microcircuit chips or dies are commonly manufactured in a wafer form whereby a large number of identical dies are built on a single substrate or wafer.

It has been found advantageous to pretest the dies in their wafer configuration rather than waiting until the dies are singulated and mounted on a leadframe, or even packaged and readied for shipment. Such a preliminary testing may involve so-called "wafer lever burn-in" wherein the dies are subjected to static and/or dynamic electrical testing under various power supply levels, temperatures and other environmental conditions. The wafer testing is usually accomplished by means of a probe having a plurality of fingers positioned to contact various points on the surface of the wafer. The conditioning of the microcircuits for various types of testing requires that the operating modes of the circuits be controlled by signals fed to the wafer through some of those contact fingers and control leads added to the wafer circuits.

It would be advantageous to find other means to condition the dies for various types of testing without having to dedicate some of the usually limited number of probe contact fingers for such controlling operations.

The majority of microelectronic circuits, and specially CMOS circuit used in high speed digital processes are sensitive to variations in the level of their supply voltage. Not only is it necessary to regulate the supply voltage fed to the microcircuits so that it remains constant within upper and lower limits of the available power source, but it is important to monitor the level of said power source in order to condition the circuits to withstand variations in the level of said power source beyond those set limits.

It would thus be advantageous to use a voltage regulator circuit for microelectronic devices which could not only regulate the available power supply but also detect excessive variations in the power source beyond a safe margin of operating voltages.

SUMMARY OF THE INVENTION

The principal and secondary objects of the invention are to provide a voltage regulating circuit, particularly adapted for use in integrated circuits, which can monitor the level of the available power supply voltage, and generate control signals when said voltage crosses over a number of critical thresholds; so that those control signals can be used to condition the microcircuits for various modes of operation, thus allowing precise control of the microcircuit operation by varying in the level of the power supply.

These and other objects are achieved by means of a voltage regulator particularly adapted for use in microcircuit electronics, which uses a logic circuit incorporating various threshold voltage detectors, which can generate control signals as well as a regulated power source. Two types of CMOS threshold voltage detectors are proposed. First, a temperature-stable P-channel detector active under low power supply conditions, and a mixed channel-type detector active under high supply voltage conditions. Each type of detector relies on a simple voltage cross-over technique utilizing the forward-biased voltage drop of diodes and transistors as stable biasing references.

BRIEF DESCRIPTION OF THE DRAWING

FIG. 1 is a simplified schematic of a first type of threshold voltage detector;

FIG. 2 is a voltage diagram thereof;

FIG. 3 is a simplified schematic of a second type of threshold voltage detector;

FIG. 4 is a voltage diagram thereof;

DESCRIPTION OF THE PREFERRED EMBODIMENT OF THE INVENTION

Figure 5:
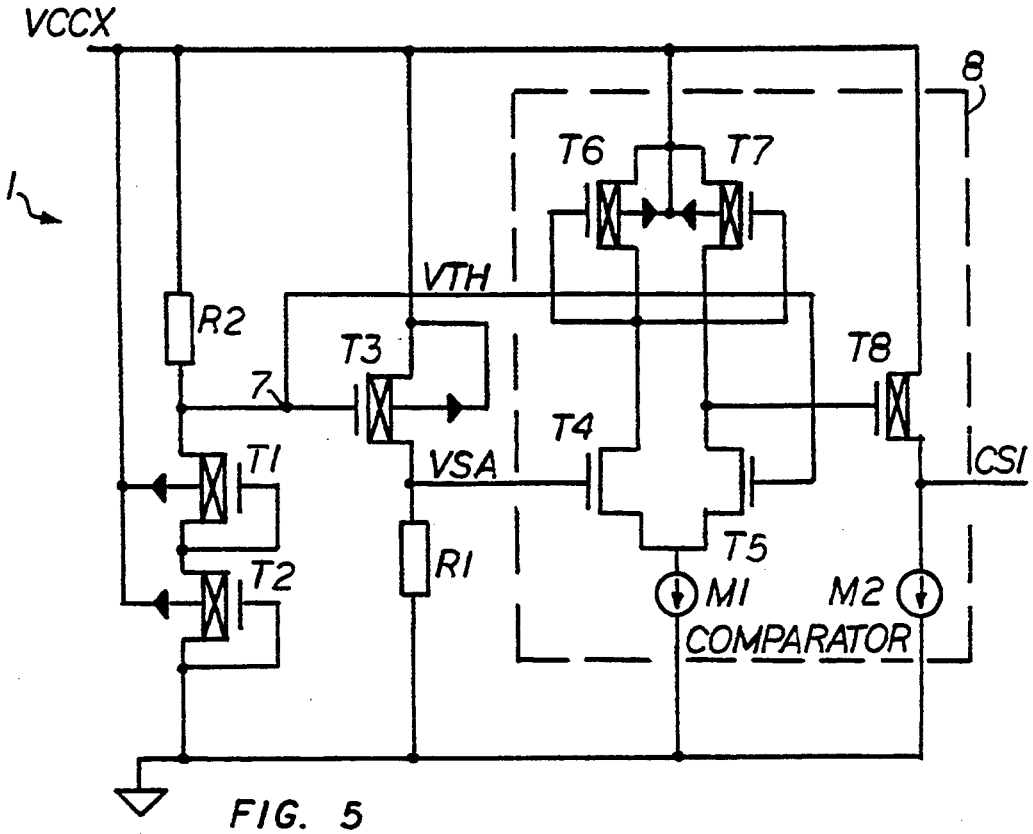
FIG. 5 is a schematic of the preferred embodiment of the first type of threshold voltage detector.

Referring now to the drawing, there is shown in FIG. 1 a threshold voltage detector logic circuit 1 which is particularly adapted for monitoring a power supply voltage VCCX. The detector 1 comprises a semiconductor 2, preferably a CMOS transistor, mounted in series with a resistive load R1 between the supply voltage VCCX and ground 3 or other voltage reference point. The transistor 2 has its source 4 connected to the supply voltage VCCX, and its drain 5 connected to one terminal of the resistive load R1. The gate 6 of the transistor is connected to a node 7 which carries a threshold voltage VTH derived from a voltage divider comprising a second resistive load R2 in series with one or more diodes CR1 and CR2. The diodes are preferably of the silicon type which exhibit a relatively constant forward-biased voltage drop between anode and cathode under a relatively wide range of applied voltage. In this case, the two diodes, with the anode of the first one connected to the node 7 and the cathode of the second one connected to the reference point 3, exhibit together a forward-biased voltage drop of approximately 2 to 3.5 volts. The node signal VTH is fed to a first input of a differential amplifier 8, while a sample voltage VSA, taken at the junction of the first resistive load R1 and the source terminal 5 of the transistor 2, is fed to the second input of the differential amplifier.

FIG. 3 illustrates the behavior of the VTH and VSA signal as the power supply voltage VCCX varies between 0 and 7 volts.

While the power supply voltage VCCX is very low and the diodes CR1 and CR2 are nonconductive, the node voltage VTH is the same as the power supply voltage VCCX, and the transistor 2 remains nonconductive. As the power supply voltage VCCX begins to exceed the diode minimum bias-voltage, the diodes begin to pass current, and the node voltage VTH begins to stabilize. As a voltage difference develops between the source 4 and gate 6 of the transistor 2, the transistor becomes conductive. The voltage across the first resistive load R1 ramps abruptly toward the power supply voltage VCCX. When the ramping sample voltage VSA crosses over the voltage threshold VTH of the node 7 the comparator 8 issues a first control signal CS1. Due to the relatively stable voltage drop of the diodes CR1 and CR2 and the stable characteristics of the transistor 2, the cross-over point 9 occurs always when the power supply voltage VCCX passes through a fixed voltage level 10 which in this case is approximately 3.5 volts. The phenomenon is the same whether power supply voltage VCCX is increasing above the critical voltage level 10 or decreasing below it, so that the cross-over point 11 between the ramping down sample voltage VSA and the threshold voltage VTH when the power supply voltage VCCX is decreased occurs at the same level as the first cross-over point 9 resulting from an increase in the power supply voltage. The comparator signal CS1 is therefore a reliable indication that the power supply voltage VCCX is passing through the critical voltage level 10. It should be understood that this critical voltage level 10 can be adjusted by increasing or decreasing the number of silicon diodes used in the voltage dividing circuit. This particular type of threshold voltage detector is preferably used to detect critical voltage levels of the power supply that are less than half the maximum excursion of the power supply voltage VCCX.

Turning now to FIG. 2, there is illustrated a second type of threshold voltage detector logic circuit that is particularly indicated for detecting a critical voltage level that is more than one-half the maximum excursion of the power supply voltage VCCX. In this case, a first resistive load R3 is connected between the power supply voltage VCCX and the drain terminal 12 of a CMOS-type transistor 13, while the source terminal 14 is connected to the ground 3 or other reference point. The gate 15 of the transistor is similarly tied to a node 16 which carries a threshold voltage VTH derived from a circuit divider. The circuit divider consists of a series of diodes CR1–CR4 connected between the power supply voltage VCCX and the node 16. A second resistive load R4 is connected between the node and the reference point 3. A comparator 17 similar to the one used in the first threshold voltage detector is used to compare the sample voltage VSA taken on the drain 12 of the transistor 13 to the threshold voltage VTH of the node 16. The behavior of those input signals are illustrated in FIG. 4.

As long as the power supply voltage VCCX remains below the minimum bias-voltage of the series of diodes CR1–CR4 the node 16 remains at the ground level. During that time no current is flowing through the transistor 13 and the sample signal VSA follows the power supply voltage VCCX. As the diodes begin to conduct current, and the node voltage VTH slowly rises toward the level of the power supply voltage VCCX less the biasing voltage of the series of diodes CR1–CR4, the transistor 13 begins to conduct and the sample voltage VSA ramps down abruptly toward 0. A control signal CS2 is provided by the comparator 17 when the sample voltage VSA falls below the threshold voltage VTH of the node 16. The second control signal CS2 occurs always when VCCX crosses over a stable critical voltage level 18 corresponding approximately to the voltage drop or bias-voltage of the series of diodes CR1–CR2 plus the bias-voltage of the transistor 13.

As was the case in the first voltage detector logic circuit 1, the cross-over points 19 and 20 between the ramp sections of the VSA signal and the threshold voltage VTH occur at the same level 18 of VCCX whether the power supply level is increased or decreased.

Figure 6:
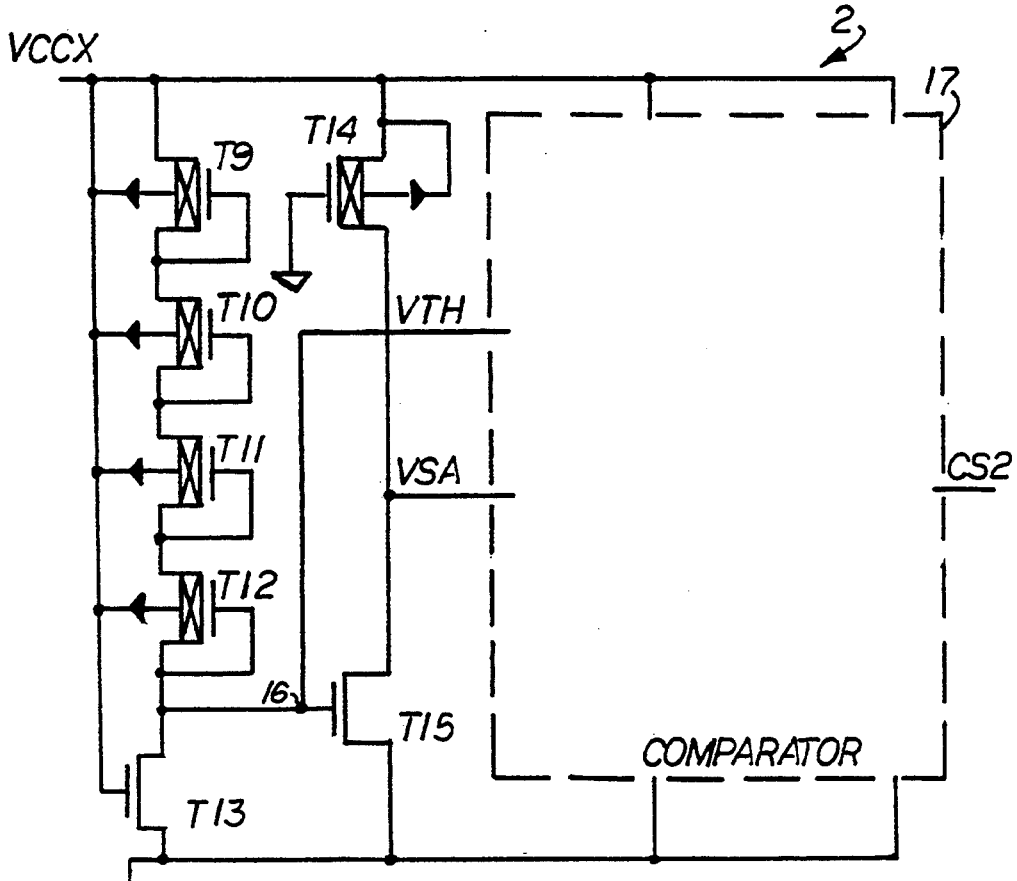
FIG. 6 is a schematic of the preferred embodiment of the second type of threshold voltage detector.

As shown in the schematics of FIGS. 5 and 6, the first threshold voltage detector logic circuit 1 consists solely of P-channel transistors so that during power-up the circuit remains immune to variations in the backbias voltage. Moreover this type of circuit is relatively immune to temperature variations. The reference diodes CR1 and CR2 of FIG. 1 are implemented with P-channel transistors T1 and T2. The comparator 8 comprises the differential amplifier consisting of transistors T4–T7, an output stage consisting of transistor T8 and current mirrors M1–M2.

The second threshold voltage detector logic circuit 2 which operates at higher VCCX levels which is not affected by variation in the back-bias voltage during power-up, incorporates both P-channel and N-channel transistors. The resistors R3 and R4 of FIG. 2 are implemented with transistors T15 and T13 respectively. This circuit exhibits a moderate temperature dependence. As temperature increases the threshold voltage VTH decreases. Since the output CS2 of this detector is to be used to switch the device to a high supply of voltage burn-in mode, the threshold level can be set slightly above the desired switch-over level 18 under normal temperature. The higher setting will prevent inadvertent triggering of the burn-in mode during spurious rises of the voltage supply at ambient temperature.

Figure 7:
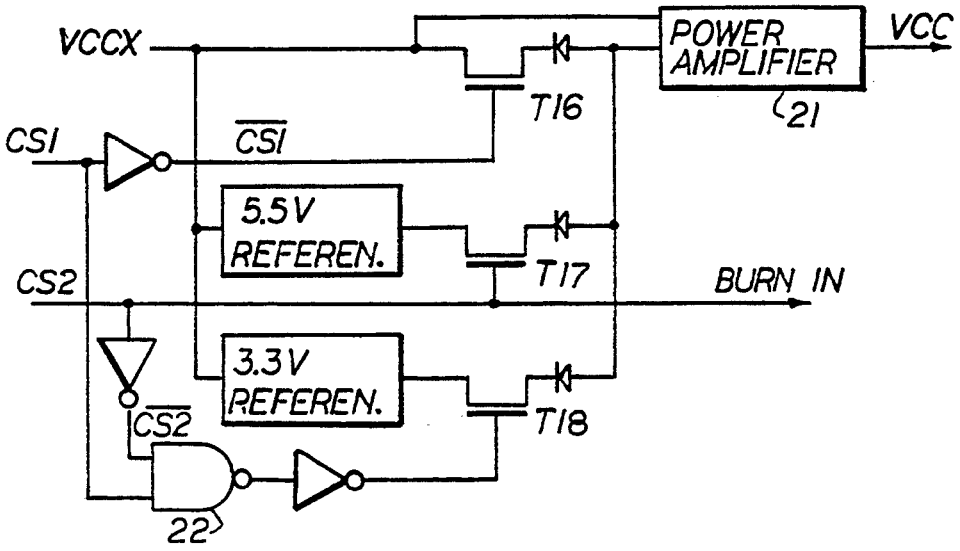
FIG. 7 is a schematic of the voltage regulator and voltage-dependent control circuit.
Figure 8:
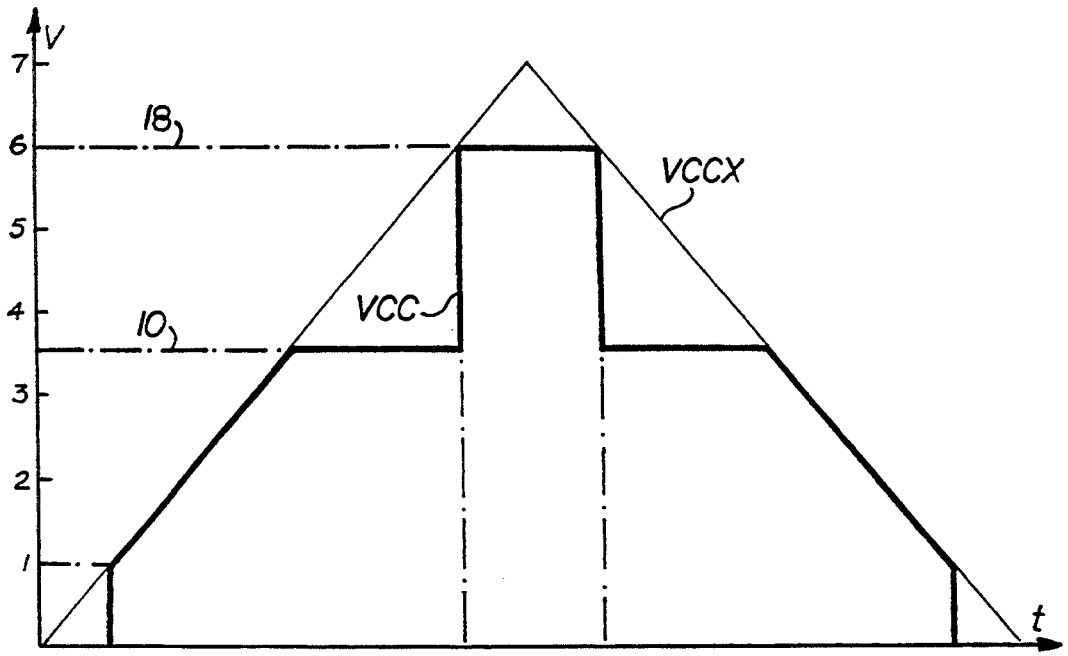
FIG. 8 is a regulating voltage diagram.

An application of the power supply voltage monitoring circuits used in connection with a wafer of integrated microcircuits is illustrated in FIGS. 7 and 8. In this application, a regulated power supply voltage VCC is generated from the unregulated power supply voltage VCCX. The ideal characteristics of the regulated supply voltage VCC in relationship to variations of the unregulated power supply voltage VCCX between 0 and 7 volts are shown in the diagram of FIG. 5. The former is to remain constant at 3.3 volts so long as the latter stays between the cross-over points of the threshold voltage VTH above or below the sample voltage VSA of the first and second circuits 1 and 2. In other words, the regulated voltage VCC has to remain constant at 3.3 volts so long as the unregulated power supply voltage VCCX is high enough to trigger the first threshold voltage detector circuit 1 without triggering the second threshold voltage detector circuit 2. When the unregulated power supply voltage VCCX is below a level corresponding to the cross-over voltage level 10 of the first threshold voltage detector 1, the regulated voltage VCC is to be clamped to the unregulated voltage VCCX. When the unregulated supply voltage VCCX exceeds the level corresponding to the cross-over voltage level 18 of the second threshold voltage detector 2, the regulated power supply voltage VCC is to be held at 5.5 volts, and the dies on the wafer are to be placed in a proper operating mode for the burn-in process. Accordingly, as illustrated in FIG. 7, the regulated power supply VCC is derived from a power amplifier 21 whose input can either be the unregulated power supply VCCX through switch T16, a 5.5 volts reference signal through switch T17, or a 3.3 volts reference signal through switch T18. The first switch T16 is open as long as the control signal CS1 from the first threshold voltage comparator circuit is low. The second switch T17 is open when the control signal CS2 from the second threshold voltage circuit 2 is high. The third switch T18 is open only when the first threshold voltage signal CS1 is high and the second threshold voltage signal CS2 is low as detected by gate 22. The 5.5 volts and 3.3 reference voltage are derived by conventional and well-known circuits from the unregulated power supply voltage VCCX. The output signal CS2 from the second threshold voltage circuit is also used as a control signal to condition the wafer for the burn-in process.

It should be understood that the above-described application is only an example of the various types of supply voltage regulating schemes and logic control circuits that can be implemented using one or both of the previously described threshold voltage comparators detector logic circuit.

While the preferred embodiments of the invention have been described, modifications can be made and other embodiments may be devised without departing from the spirit of the invention and the scope of the appended claims.

What is claimed is:

1. A circuit, responsive to variations in its unregulated supply voltage and including means for switching the operation of a microcircuit device between modes having different regulated supply voltage requirements, wherein said means for switching comprises:

at least one logic circuit powered by said unregulated supply voltage, said at least one logic circuit including means for generating a control signal when and as long as said unregulated supply voltage exceeds a preset voltage level; and means responsive to said control signal for applying a first regulated supply voltage to said microcircuit device wherein said means for generating comprises:

a semiconductor switch having a control gate;

a first resistive load connected in series with said semiconductor switch between said unregulated supply voltage and a reference point;

a voltage divider circuit comprising a second resistive load and at least one diode having a forward-biased voltage drop:

said at least one diode being conductively connected in series with said second resistive load between said unregulated supply voltage and said reference point;

said voltage divider circuit including a node between said at least one diode and said second resistive load;

means for triggering an abrupt current flow through said semiconductor switch when said unregulated supply voltage crosses over said forward-biased voltage drop and said at least one diode begins to conduct current, said means for triggering including means for driving said control gate with a first voltage developed on said node by said at least one diode; and wherein at least one logic circuit further comprises means for producing said first control signal when a second voltage developed across said first resistive load crosses over said first voltage, said means for producing including a comparator having a referencing input connected to said control gate, and a voltage sampling input connected to a junction of said first resistive load and said semiconductor switch.

2. The circuit of claim 1, wherein said at least one logic circuit comprises:

a first logic circuit including means for generating a first control signal when and as long as said unregulated supply voltage exceeds a first preset voltage level, and a second logic circuit including means for generating a second control signal when and as long as said unregulated supply voltage exceeds a second preset voltage level higher than said first preset level; and means for applying a first regulated supply voltage to said microcircuit device in response to said first control signals, and means for applying a second regulated supply voltage to said microcircuit device in response to said second control signal.

3. The circuit of claim 2, which further comprises means for applying a power supply voltage to said microcircuit device, said power supply voltage having a voltage level corresponding to said unregulated supply voltage in the absence of said first control signal.

4. The circuit of claim 2, wherein said voltage comparator comprises an amplifier having a pair of differential inputs respectively fed with said first and second voltages.

5. The circuit of claim 2, wherein the first resistive load has a first terminal connected to said reference point and a second terminal connected to said semiconductor; and said second resistive load has a first terminal connected to said unregulated supply voltage and a second terminal connected to said at least one diode; and wherein said at least one diode has a forward biased voltage drop lesser than ½ the voltage difference between said unregulated supply voltage and said reference point.

6. The circuit of claim 2, wherein said first resistive load has a first terminal connected to said unregulated supply voltage and a second terminal connected to said semiconductor, and said resistive load has a first terminal connected to said reference point and a second terminal connected to said at least one diode; and wherein said at least one diode has a forward biased voltage drop of more than ½ the voltage difference between said unregulated supply voltage and said reference point.

7. The circuit of claim 6, which further comprises means for changing operating modes of said microcircuit device in response to said first control signal.

8. The circuit of claim 7, which further comprises means for changing operating modes of said microcircuit device in response to said second control signal.

9. A circuit, responsive to variations in its unregulated supply voltage and including means for controlling the operation of a microcircuit device, wherein said means for controlling comprises:

at least one logic circuit powered by said unregulated supply voltage, said logic circuit including means for generating a first control signal when and as long as said unregulated supply voltage exceeds a preset voltage level;

wherein said means for generating comprises:

a semiconductor switch having a control gate;

a first resistive load connected in series with said semiconductor switch between said unregulated supply voltage and a reference point;

a voltage divider circuit comprising a second resistive load and at least one diode having a forward-biased voltage drop, said at least one diode being conductively connected in series with said second resistive load between said unregulated supply voltage and said reference point;

said voltage divider circuit including a node between said at least one diode and said second resistive load;

means for triggering an abrupt current flow through said semiconductor switch when said unregulated supply crosses over said forward-biased voltage drop and said at least one diode begins to conduct current, said means for triggering including means for driving said control gate with a first voltage corresponding to said voltage-drop and developed on said node; and wherein said at least one logic circuit further comprises means for producing said first control signal when a second voltage developed across said first resistive load crosses over said first voltage, said means for producing including a comparator having a reference input connected to said control gate, and a voltage sampling input connected to a junction of said first resistive load and said semiconductor.

10. The circuit of claim 9, wherein said voltage comparator comprises an amplifier having a pair of differential inputs respectively fed with said first and second voltages.

11. The circuit of claim 10, wherein the first resistive load has a first terminal connected to said reference point and a second terminal connected to said semiconductor; and said second resistive load has a first terminal connected to said unregulated supply voltage and a second terminal connected to said at least one diode; and wherein said at least one diode has a forward biased voltage drop lesser than $\frac{1}{2}$ the voltage difference between said unregulated supply voltage and said reference point.

12. The circuit of claim 10, wherein said first resistive load has a first terminal connected to said unregulated supply voltage and a second terminal connected to said semiconductor, and said second resistive load has a first terminal connected to said reference point and a second terminal connected to said at least one diode; and wherein said at least one diode has a forward biased voltage drop of more than $\frac{1}{2}$ the voltage difference between said unregulated supply voltage and said reference point.

13. The circuit of claim 12, which further comprises means for changing operating modes of said microcircuit device in response to said first control signal.

* * * * *